United States Patent [19]

Firey

[11] 4,433,547

[45] Feb. 28, 1984

[54] TORQUE LEVELLER

[76] Inventor: Joseph C. Firey, P.O. Box 15514, Seattle, Wash. 98115

[21] Appl. No.: 403,923

[22] Filed: Jul. 30, 1982

[51] Int. Cl.[3] ..... F01B 21/04

[52] U.S. Cl. ..... 60/711; 60/716; 290/4 C

[58] Field of Search ..... 60/698, 711, 716; 290/4 C

[56] References Cited

U.S. PATENT DOCUMENTS

| | | | |
|---|---|---|---|
| 2,647,372 | 8/1953 | Fell | 60/711 |
| 3,548,596 | 12/1970 | Mizushina et al. | 60/711 |
| 4,137,721 | 2/1979 | Glennon et al. | 60/711 |

OTHER PUBLICATIONS

SAE Technical Paper #831302, "A Novel Approach to Engine Torque Speed Control", D. G. Brown & S. Thompson.

*Primary Examiner*—Allen M. Ostrager
*Assistant Examiner*—Stephen F. Husar

[57] ABSTRACT

Governor devices are described for use on multi-engine plants, some of whose engines experience periodic torque variations, which act upon the torque regulator of at least one of the engines to maintain a steady torque and speed of the common final power output shaft of the plant.

19 Claims, 6 Drawing Figures

TORQUE LEVELLER

CROSS REFERENCES TO RELATED APPLICATIONS

The invention described herein is particularly well suited for use with my earlier filed U.S. patent application entitled, "Improved Cycic Char Gasifier," Ser. No. 06/328148, filing date Dec. 7, 1981, Group Art Unit 173.

BACKGROUND OF THE INVENTION

1. Field of the Invention

This invention is in the field of torque governing and speed governing of engines and particularly for engines whose torque and power varies appreciably over a period of several cycles or revolutions.

2. Description of the Prior Art

Engines developing mechanical torque and power may experience periodic torque and power variations when operated in various ways. Torque variations can be of two types, in-cycle torque variations and periodic torque variations as defined hereinafter. When torque variation occurs during the time of an engine cycle, this variation is herein and in the claims defined as an in-cycle torque variation. A cycle of an engine occurs within the time interval, expressed usually in engine output shaft revolutions, for completion of at least one single cycle of that kind of engine. For example, for a four-stroke cycle gasoline or diesel engine, two revolutions of the engine crankshaft are needed to complete at least one single engine cycle. For turbine engines, a single shaft revolution completes at least a single cycle in that each moving blade is then returned to its original starting point to recommence passing the fixed nozzles. When torque variation occurs at corresponding times or positions between separate engine cycles, this variation is herein and in the claims defined as a periodic torque variation and is a longer term variation of torque than is an in-cycle torque variation. When an engine is running at essentially steady speed, periodic torque variations create corresponding power output variations.

Where a reasonably steady torque is desired to be delivered from the final power output shaft, it is common practice in prior art of engines to add a flywheel to the engine in order to reduce in-cycle torque variations in the final power output shaft. When torque developed by the engine exceeds delivered torque, the flywheel speeds up and the excess power is transformed into flywheel kinetic energy. When torque developed by the engine is less than delivered torque, the flywheel slows down and some of its kinetic energy is delivered into the final power output shaft. In this way, a flywheel can act to reduce torque variations in the final power output shaft of an engine by use of a small speed variation.

In theory, a flywheel can also be used similarly to reduce torque variations of the periodic type, but this is usually impractical since these longer term periodic torque variations would require use of either an excessively large and heavy flywheel, or of an excessive speed variation in the final power output shaft, or of an excessively high operating speed of the flywheel.

Examples of engines experiencing periodic torque and power variations are as follows:

a. The engine utilized in my cross-referenced U.S. Patent application entitled, "Improved Cyclic Char Gasifier."

b. The engine utilized for driving the compressor in U.S. Pat. No. 2,675,672, C. Shorner.
c. A wind-driven engine.
d. A water turbine utilizing tidal lift and rise as its energy source.
e. A steam turbine, driving an electric generator, whose exhaust steam is used for building heating purposes and whose steam flow rate is set by this heating load.
f. An internal combustion engine or a gas turbine engine whose fuel supply rate may vary with time as, for example, for a sewage treatment plant whose evolved gas is the engine fuel.

In some applications these periodic torque and power variations are unimportant as, for example, when a wind-driven engine is used to pump water into a tank. In other applications, these periodic torque and power variations create serious control problems as, for example, when a large steam turbine or gas turbine engine is generating fixed frequency electric power for delivery into a regional electric power grid. In this latter example, the power input variations due to the varying engine must be compensated by offsetting power variations of other engines seving the same power grid by action of the governors on the offsetting engines. These required governor control actions on the offsetting engines may significantly reduce their efficiency.

Practically all engines are equipped with a means for regulating the engine torque output and examples of these torque regulator means are as follows:

a. The intake mixture throttle on a gasoline engine.
b. The fuel flow rate control on the injection pump of a diesel engine.
c. The inlet steam pressure throttling valve on a steam turbine.
d. The inlet steam nozzle flow area controller on a steam turbine.
e. The fuel flow rate control for a gas turbine engine.
f. The inlet nozzle flow area controller on a gas turbine or a water turbine.

Frequently only one of these torque regulator means is used alone, but in some applications combination of two or more torque regulator means are used. For example, in some large steam turbines, torque is regulated by inlet steam throttling valves for small changes and also by nozzle flow area controllers for large changes.

References:

A. "Elements of Mechanism," P. Schwamb, A. Merrill, W. James, John Wiley, 1930; Chap. 8, page 198 figure 240, page 192 figure 232.
B. "Vibration Problems In Engineering," S. Timoshenko, 2nd Ed., D. Van Nostrand, 1937; page 453 to 456.
C. "Mechanical Engineering Experimentation," G. Tuve, McGraw-Hill, 1961; Chap. 4 pages 83 to 85, chap. 5 page 127.
D. "Mechanical Engineering Experimentation," G. Tuve, McGraw-Hill, 1961; chap. 4 pages 71 to 72.
E. "Mechanical Engineering Experimentation," G. Tuve, McGraw-Hill, 1961; chap. 4 pages 76 to 77.

SUMMARY OF THE INVENTION

The devices of this invention are governors used on engine plants comprising two or more engines coupled to a common final power output shaft and with at least one of said engines being equipped with a torque regulator. These governors comprise; a torque sensor to sense the torque in the common final power output shaft, a speed sensor to sense the speed of the common final power output shaft, a control means responsive to said torque sensor and to said speed sensor and operative upon said torque regulator to hold a steady torque in the common final power output shaft adequate to maintain a steady speed of this shaft. Various types of engines, couplings, torque regulators, torque sensors, speed sensors, and control means can be used and in various combinations.

A principal beneficial object of this invention is that the torque and speed output of an engine plant can be maintained steady even though the torque output of one or some, of the engines of the plant varies periodically. In this way, these engines experiencing periodic torque variations, such as the cyclic char gasifier engines of the cross-referenced application, can be adapted for use in applications where steady torque and speed are needed as, for example, electric power generation.

Figure 2:
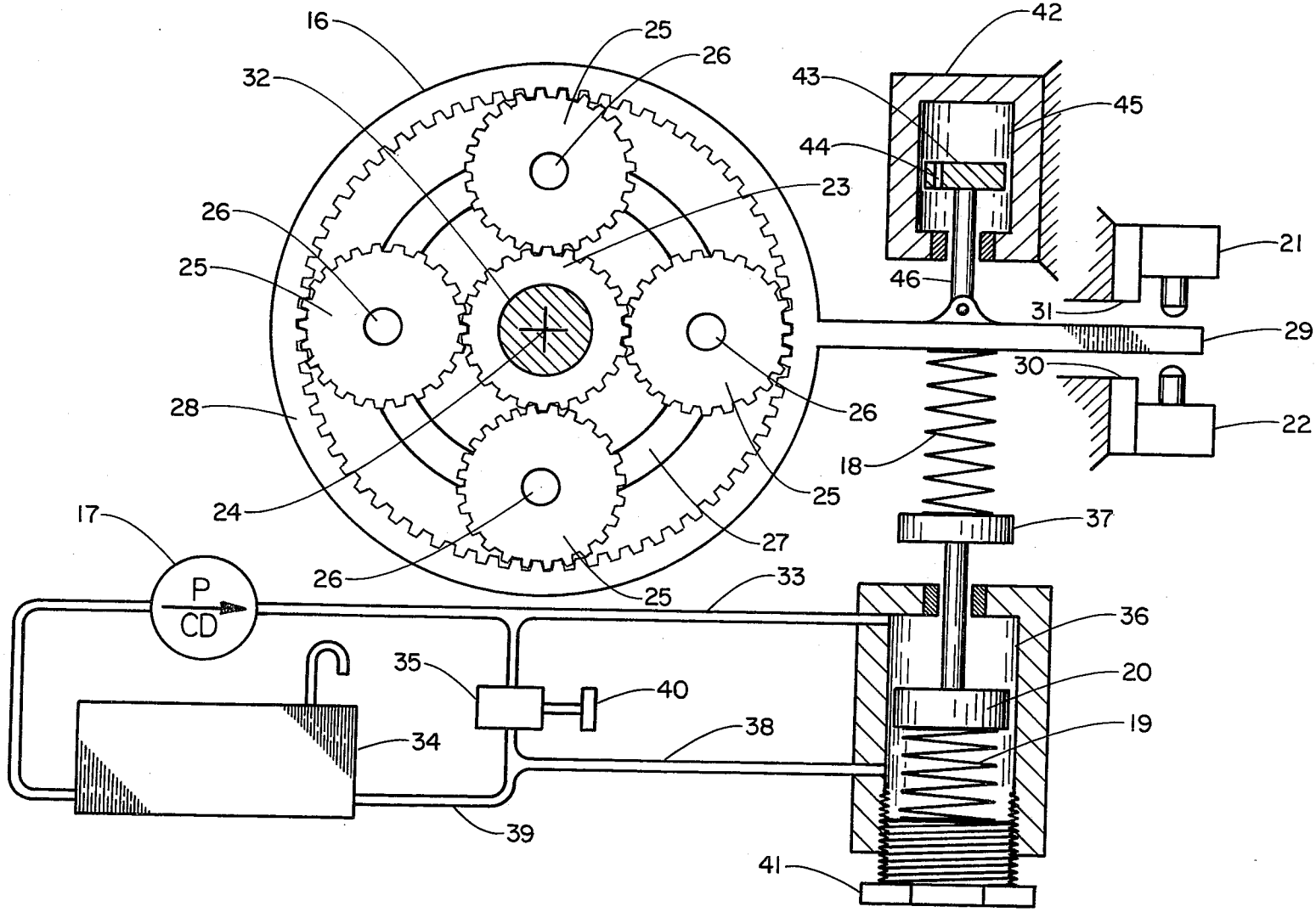

A transmission type torque sensor, 16, of the epicyclic gear type, is shown in FIG. 2 together with a direct speed sensor of the oil pump, 17, and flow restrictor, 35, type. Spring and piston controllers, 18, 19, 20, and electric switch actuators, 21, 22, act upon the torque regulator of a leveller engine.

Figure 3:
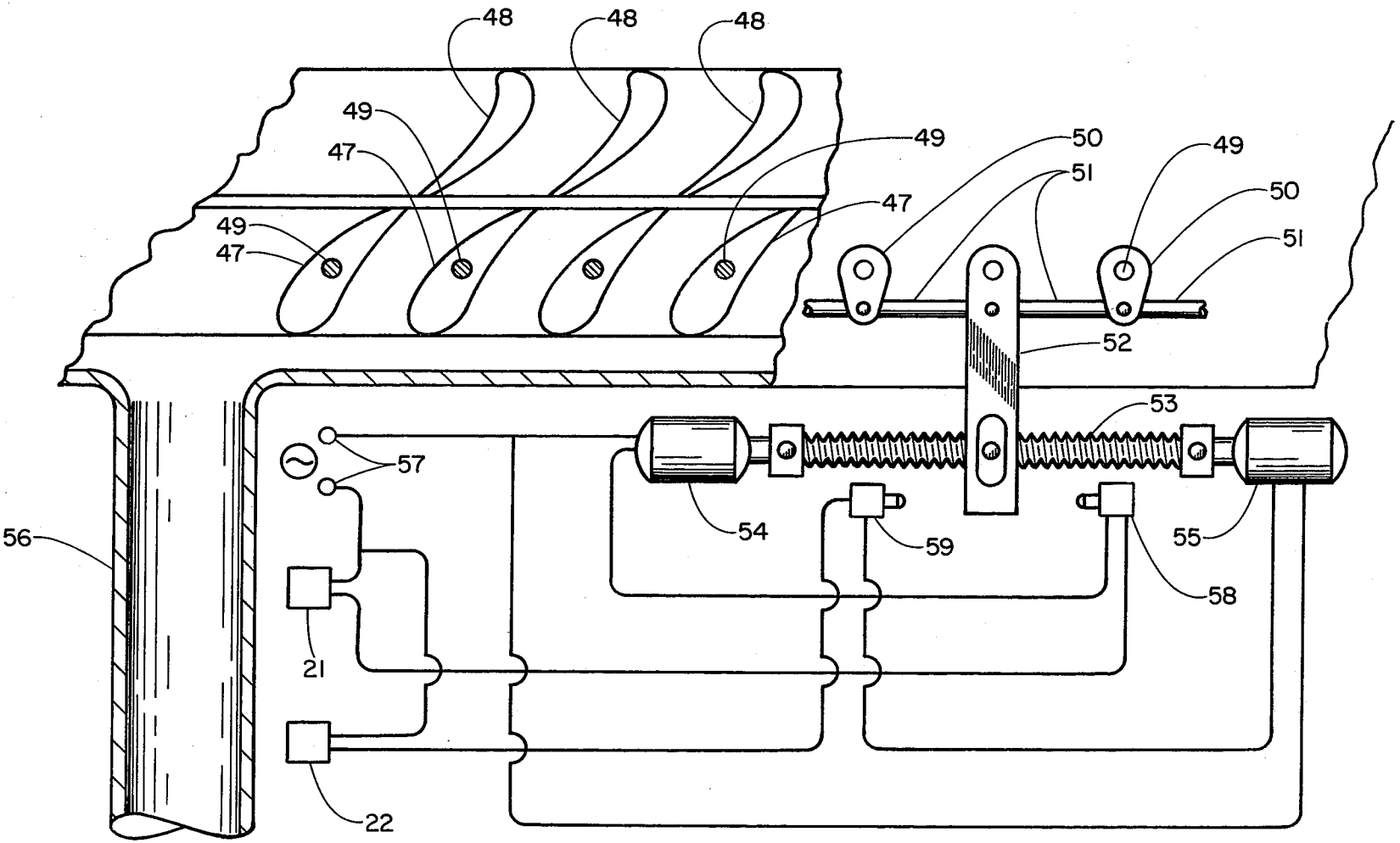

In FIG. 3 one type of turbine nozzle flow area torque regulator is shown.

Figure 4:
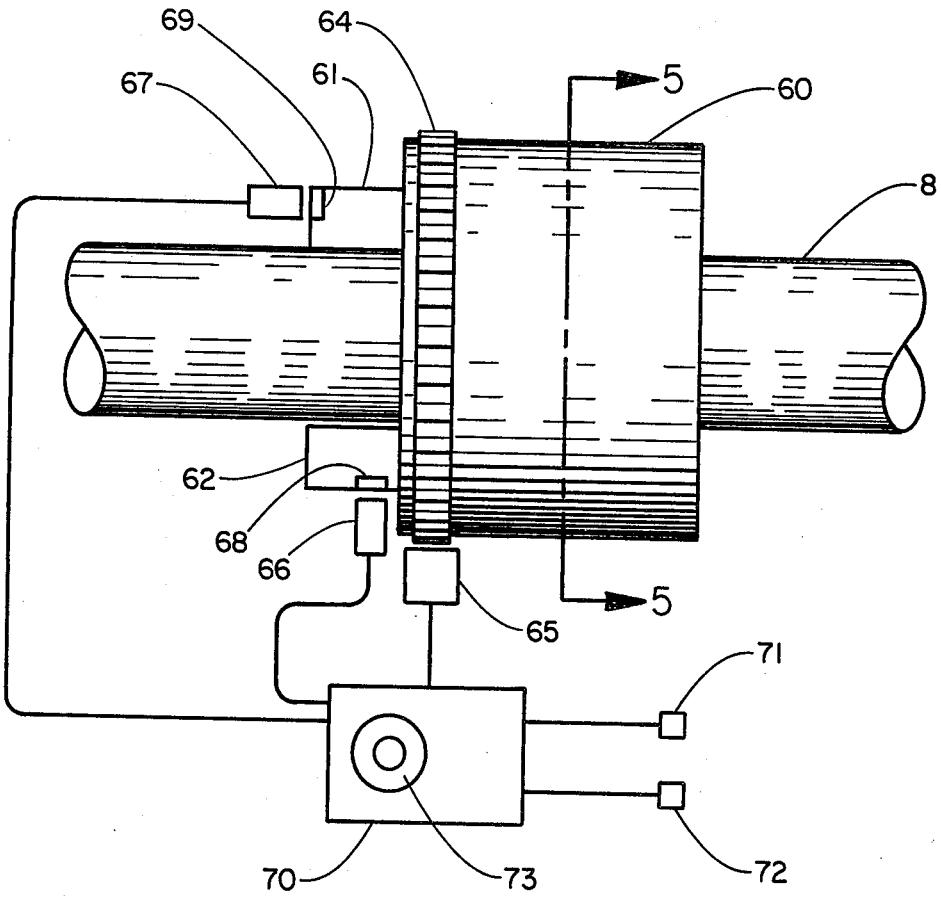
Figure 5:
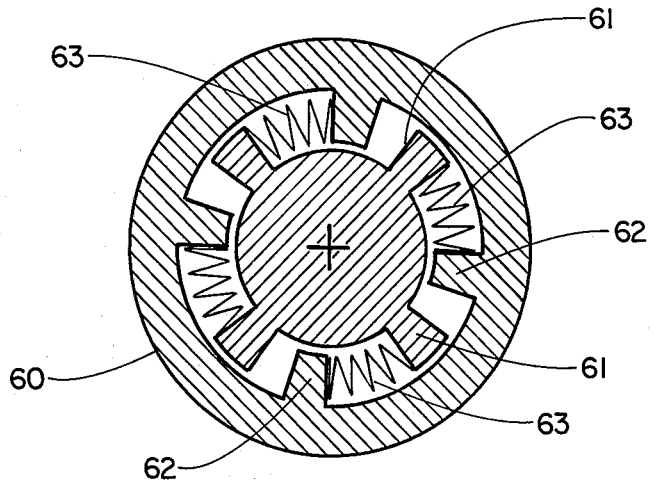

A deflection type torque sensor, 60, and a time interval type of speed sensor, 64, 65, are shown in FIGS. 4 and 5, together with an electrical controller, 70.

Figure 6:
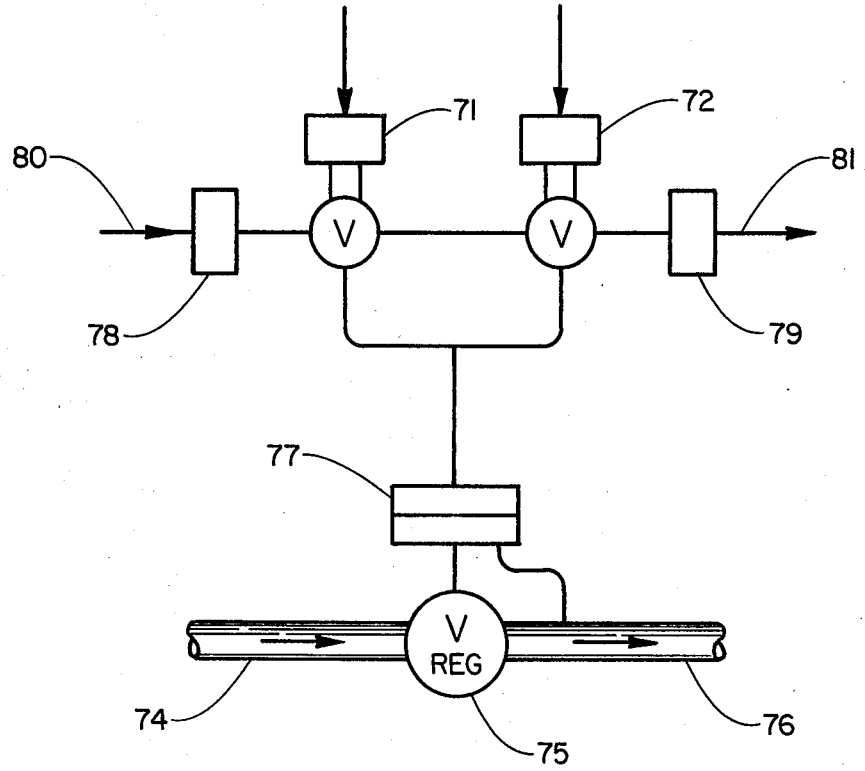

In FIG. 6 a throttling type torque regulator, 75, is shown.

DESCRIPTION OF THE PREFERRED EMBODIMENTS

Figure 1:
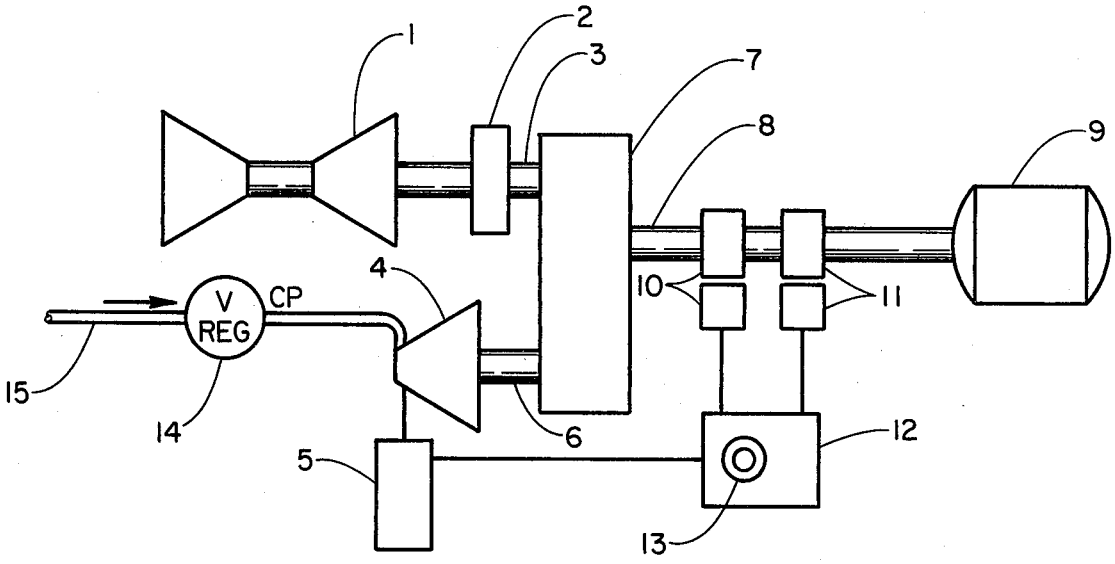
In FIG. 1 is shown schematically an engine plant comprising at least one primary engine, 1, which may experience periodic torque variations, a leveller engine, 4, with a torque regulator, 5, a coupling, 7, connecting these engines to a common final power output shaft, 8, driving the load, 9. A torque sensor, 10, and a speed sensor, 11, are inputs to a controller, 12, which acts upon the torque regulator, 5.

The devices of this invention are engine plants and comprise one or more primary engines whose torque and power in the output shaft may have a periodic variation; a leveller engine with a torque regulator; a means for coupling the output shaft of the primary engines and the output shaft of the leveller engine to a common final output shaft; means for sensing the torque and means for sensing the speed of the common final output shaft; a control means responsive to the torque sensor and to the speed sensor and acting upon the torque regulator of the leveller engine to hold a steady torque in the common final output shaft which is adequate to maintain a steady speed of the final output shaft. One particular example of an engine plant of this invention is shown schematically in FIG. 1. A primary engine, 1, fitted with a flywheel, 2, may experience torque and power variations in its power output shaft, 3. A leveller engine, 4, with a torque regulator, 5, has its power output shaft, 6, coupled into the same gearbox, 7, to which the primary engine power output shaft, 3, is also coupled. The thusly combined torque and power output of the primary engine, 1, and the leveller engine, 4, are delivered from the gearbox, 7, via the common final power output shaft, 8, which in turn drives the load, 9, of this engine plant, such as an electric generator. A torque sensor,10, measures the torque in the final common power output shaft, 8, and a speed sensor, 11, measures the speed of this shaft. A controller, 12, compares the torque measured by the sensor, 10, against a set torque value and acts upon the leveller engine torque regulator, 5, to increase leveller engine torque whenever measured torque is below set torque and to decrease leveller engine torque whenever measured torque is above set torque. The controller, 12, also compares the speed measured by the sensor, 11, against a set speed value and acts upon the set torque value to increase the set value of torque whenever the measured speed is below the set speed and to decrease the set value of torque whenever the measured speed is above the set speed. The set speed value can be fixed and non-adjustable or can be adjustable, as by hand, via a speed adjustor, 13, on the controller, 12. A gearbox coupling, 7, between the primary engine power output shaft, 3, the leveller engine power output shaft, 6, and the common final power output shaft, 8, is shown in FIG. 1, but other types of couplings can be used such as direct coupling on a single common shaft, hydraulic coupling via hydraulic pumps and motors, electric coupling via electric generators and motors, etc. An added flywheel, 2, is shown for the primary engine, 1, but this may not always be needed if the in-cycle torque variations of the primary engine are very small, as with a turbine engine. In FIG. 1 the leveller engine 4, is shown receiving a constant pressure driving fluid supply, such as fuel gas or high-pressure steam, via a constant pressure regulator, 14, from a supply pipe, 15, and with the torque regulator, 5, acting to adjust inlet flow area, such as turbine nozzle inlet area, in order to adjust the torque output of the leveller engine, 4. But the torque regulator, 5, of the leveller engine, 4, can alternatively function in other ways as by adjusting the pressure of the driving fluid, or by adjusting the flow rate of the leveller engine fuel, etc., as described in the Descrption of the Prior Art. The leveller engine, 4, is shown in FIG. 1 as a separate engine but can alternatively be integral with the primary engine, 1, as, for example: A portion of the cylinders of a primary multicylinder internal combustion engine with the torque regulator of this portion separate from that of the remaining primary engine cylinders: a separately controlled group of nozzles in a primary turbine engine. A flywheel may also be used on the common final output shaft on the load side of the torque sensor to reduce the effects of sudden load changes. A single primary engine is shown in FIG. 1 but more than one primary engines and of different kinds may be used provided all are coupled to the same common final power output shaft.

The operation of the FIG. 1 form of this invention can be described as follows. When the torque output of the primary engine, 1, decreases periodically, so also then does the torque in the common final output shaft, 8, and the torque sensor, 10, then acts via the controller, 12, and the torque regulator, 5, to increase the torque output of the leveller engine, 4, until the torque in the common output shaft, 8, is restored to set value. The reverse control effects occur when the torque output of the primary engine, 1, increases. When the external load, 9, increases the speed of the common final output shaft, 8, decreases and the speed sensor, 11, acts via the controller, 12, to increase the set value of torque and the controller then acts upon the torque regulator, 5, to increase the torque output of the leveller engine, 4, until the speed of the common final output shaft is restored to set value. The reverse control effects occur when the external load, 9, decreases. In these ways the torque in the common final output shaft, 8, is maintained steady at set value and this set value is maintained adequate to keep the speed of the common final output shaft, 8, steady.

The leveller engine, 4, can be any type of engine, such as those described in the Description of the Prior Art, and should have a maximum power generating capacity at least equal to the maximum difference between the power output of the primary engine, 1, and the power required to drive the external load, 9. The power output of the leveller engine, 4, should also be adjustable, via the torque regulator, 5, between its maximum value and either zero or at least the minimum difference between the power output of the primary engine, 1, and the power required to drive the external load, 9.

Any of various different kinds of torque sensors can be used as the torque sensor means for this invention. Prior art torque meters are of either the transmission type or of the deflection type and both of these prior art types are useable herein. In a transmission type torque sensor the shaft torque is transmitted via a gear train or other transmission, one of whose reaction members is preferably stationary and the reaction force on this reaction member is sensed as proportional to transmitted torque. In a deflection type torque sensor, the deflection of the shaft, or a particular portion of the shaft or a coupling on the shaft, is sensed as proportional to transmitted torque. Transmission torque sensors have the advantage that the force can be readily measured on the stationary reaction member and wholly mechanical sensing methods can be used here if desired. Deflection torque sensors usually have the advantage of lower cost but measuring the deflections of the moving shaft is difficult and electrical or optical measurement methods are most commonly used for this purpose. References A, B, and C describe some prior art torque sensors or devices useable for torque sensing purposes.

Any of various different kinds of speed sensors can be used as the speed sensor means for this invention. Prior art speed sensors are of the direct speed sensing type or of the time interval counter type. Speed sensors such as of the flyball weight and spring type, the electric voltage generator type or the electric frequency generator type are direct speed sensors. Counters which count shaft revolutions or portions of a shaft revolution for a fixed time interval, or alternatively count time intervals for a fixed number of shaft revolutions or part revolutions, are examples of speed sensors of the time interval counter type and can be of either mechanical or electrical or combination type. References D and E describe examples of prior art speed sensors.

The controller, 12, comprises comparator elements and actuator elements and can be wholly mechanical or wholly electrical or combination type. One comparator compares measured torque against set torque and energizes an actuator to adjust the leveller engine torque regulator to increase leveller engine torque when measured torque is less than set torque and to decrease leveller engine torque when measured torque is more than set torque. Another comparator compares measured final common output shaft speed against set speed an energizes an actuator to adjust the set torque value in the torque comparator so that set torque is increased when measured speed is below set speed and so that set torque is decreased when measured speed is above set speed. Added elements may also be incorporated into the controller such as; a hand adjustor of the set speed value; an automatic adjustor of the set speed value in response to some external purpose; readouts of measured torque and speed; etc. Any of various different kinds of comparator and actuator elements can be used in the controller means of this invention, and the selection of these elements is only limited by the necessity that they function properly with the speed sensor, the torque sensor, and the leveller engine torque regulator, with which they are connected.

One particular example of a portion of this invention is shown in FIG. 2 and comprises a transmission torque sensor, 16, of mechanical epicyclic geared type, a direct speed sensor, 17, of the shaft driven hydraulic pump and flow restrictor type, a spring comparator, 18, for torque comparison, a spring comparator, 19, for speed comparison, a hydraulic actuator, 20, for adjustment of the set torque value, and electric switch (or pneumatic or hydraulic valve) actuators, 21, 22, for adjustment of the leveller engine torque regulator. The epicyclic torque sensor, 16, comprises a sun gear, 23, rotated by the common final driving shaft, 32, about its centerline, 24, planetary gears, 25, rotatable on their planetary shafts, 26, with these planetary shafts secured to the train arm, 27, which is secured to and rotates with the driven shaft whose centerline is coincident with the driving shaft centerline, 24, and an internal ring gear, 28, prevented from rotating by the torque arm, 29, and the stops, 30, 31. As thus shown in FIG. 2, the epicyclic gear train functions as a reduction gear with the speed of the train arm, 27, and hence the driven shaft, less than the speed of the sun gear, 23, and hence the driving shaft. This gear train could alternatively function as a speed increaser by reversing the sun gear and train arm connections to driving and driven shafts. The planetary gears, 25, mesh with both the sun gear, 23, and the stationary ring gear, 28, and thus the force acting upon the torque arm, 29, is proportional to the torque in the driving shaft, 32, and in this way the torque in the common final output shaft, 32, is sensed.

The force in the torque arm, 29, acts against the torque comparator spring, 18, which is precompressed to the set value. When sensed torque arm force exceeds the set value force of the comparator spring, 18, the torque arm, 29, moves against the stop, 30, and thus closes the reduce switch, 22, which acts upon the leveller engine torque regulator to reduce leveller engine torque output as explained hereinafter. When sensed torque arm force is less than the set value force of the comparator spring, 18, the torque arm, 29, moves against the stop, 31, and thus closes the increase switch, 21, which acts upon the leveller engine torque regulator to increase leveller engine torque output. The switches, 21, 22, and the stops, 30, 31, are positioned so that only one of the switches can be closed at a time, the other switch being then open. In this way, the torque sensor and comparator portion of the controller example shown in FIG. 2 functions to maintain a steady torque in the common final output shaft, 32, proportional to the set value in the comparator spring, 18.

A positive displacement oil pump of constant displacement, 17, driven at a fixed speed ratio from the common final power output shaft, 32, pumping oil from a reservoir, 34, through a flow restrictor, 35, and through various passages of low flow restriction back to the reservoir, comprises the speed sensor for the particular example of FIG. 2. As shaft speed and hence oil pump speed increase, a greater flow of oil occurs through the flow restrictor, 35, and a greater pressure drop occurs across the restrictor. The reverse effects take place when shaft speed decreases. Thus, the pressure drop across the flow restrictor, 35, is a function of the speed of the common final power output shaft, 32, varying approximately as the square of the shaft speed. Shaft speed is thus sensed as this pressure drop. This pressure drop is applied via the pipes, 33, 38, 39, across the speed comparator piston, 20, in the speed comparator cylinder, 36, which forces the piston, 20, against the speed comparator spring, 19. At set speed the comparator spring, 19, and the comparator piston, 20, are compressed to a set position and the torque spring base, 37, secured to the speed comparator piston, 20, then places a set value of precompression into the torque comparator spring, 18. When the speed of the shaft, 32, increases above set value, the resulting increased pressure drop forces the piston, 20, further against the speed comparator spring, 19, thus decreasing the set value of precompression of the torque comparator spring, 18, and the torque sensor and actuators, 21, 22, then act via the leveller engine torque regulator to decrease the torque output of the leveller engine in order to decrease the speed of the shaft, 32, until it is restored to set speed. The reverse effects take place when shaft speed decreases. In this way, the speed sensor and comparator example shown in FIG. 2 functions by changing the set value of torque in the torque comparator which then acts via the actuators and the torque regulator to maintain a constant speed of the common final power output shaft, 32, as set into the speed comparator spring, 19.

As shown in FIG. 2, the speed comparator spring actually comprises the spring, 19, plus the torque comparator spring, 18, since they are connected together at one end. Interaction of the speed comparator and the torque comparator via this connection can be reduced as far as desired by use of high oil pressures in the oil pump, 17, by use of a large piston area of the piston, 20, or by use of both, so that the speed comparator spring, 19, is generating much stronger forces than the torque comparator spring, 18.

The value of set speed can be fixed into the pump, 17, displacement, the restrictor, 35, flow area, the piston, 20, area, and the spring, 19, design and position. Alternatively, the value of set speed can be made adjustable in various ways or combinations of ways as, for example:

a. the flow restrictor, 35, can be a valve whose flow area is adjustable via the valve handle, 40.
b. The oil pump, 17, can be positive displacement oil pump whose displacement can be adjusted, such as the common swash plate driven plunger pump whose swash plate angle is adjustable.
c. the stationary end of the speed comparator spring, 19, can be adjusted as via a threaded fitting, 41.

Such adjustment of the value of set speed can be made by hand or automatically in response to some requirement of the machine being driven.

A dashpot, 42, is shown in the example of FIG. 2 and may be preferred in those cases where either the primary engine or the leveller engine produce appreciable in-cycle torque variations, as for internal combustion engines. A dashpot will usually be unnecessary in those cases where such in-cycle torque variations are very small, as for turbine engines. The example dashpot, 42, of FIG. 2 comprises a piston, 43, containing a restricted flow passage, 44, and fitted closely inside a sealed cylinder, 45, which is filled throughout with a viscous fluid, the piston, 43, connecting via the link, 46, to the torque arm, 29. The dashpot prevents rapid motions of the torque arm, 9, in response to in-cycle torque variations but does not appreciably restrain torque arm motions in response to the slower, longer term, periodic torque variations. A piston, cylinder and viscous fluid damper is shown in FIG. 2 as an example but other types of dashpot can alternatively be used.

One example of a leveller engine torque regulator is shown diagrammatically in FIG. 3, as adapted to a turbine engine, comprising first stage inlet non-rotating nozzle guide vanes, 47, which direct the leveller engine working fluid against the first stage rotating blades, 48, to produce torque. The nozzle flow area between the inlet guide vanes, 47, can be adjusted by rotating the guide vane about their pivots, 49, by the levers, 50, with each guide vane, 47, having a lever, 50, and these levers are connected together by links, 51, so that all inlet guide vanes are rotated together similarly. The levers, 50, are thusly rotated by the arm, 52, moved in turn by a nut fitting the threaded shaft, 53. The threaded shaft, 53, is rotated so as to open the nozzle flow area by the open motor, 54, and is rotated so as to close the nozzle flow area by the close motor, 55, these being electric motors and preferably constant speed electric motors. The working fluid is supplied to the leveller engine at constant pressure via the turbine inlet pipe, 56, as in the example of FIG. 1. When the close switch, 22, is closed by the torque controller of FIG. 2, the close motor, 55, is energized from the electric power source, 57, via the close limit switch, 59, and the inlet nozzle flow area is reduced, thus reducing the leveller engine torque output. When the open switch, 21, is closed by the torque controller of FIG. 2, the open motor, 54, is energized from the electric power source, 57, via the open limit switch, 58, and the inlet nozzle flow area is increased, thus increasing the leveller engine torque output. The actuator scheme of FIG. 3 thus responds to the controller of FIG. 2 to maintain steady torque and speed of the common final output shaft.

The close limit switch, 59, prevents further nozzle closing after maximum closing has been reached and the lever, 52, has engaged and opened the limit switch, 59, preventing energizing of the close motor, 55. The open limit switch, 58, prevents further nozzle opening after full opening has been reached and the level, 52, has engaged and opened the limit switch, 58, preventing energizing of the open motor, 54.

An electrically energized leveller engine flow rate controller is shown in FIG. 3 but hydraulic or pneumatic control schemes can also be used as is well known in the art of flow rate controllers. Nozzle flow area is controlled by the scheme shown in FIG. 3 but a similar control could act instead to adjust a throttle valve in the leveller engine inlet pipe.

Another particular example of a portion of this invention is shown in FIG. 4, with a cross section view of the deflection type torque sensor shown in FIG. 5. The torque sensor, 60, comprises driving members, 61, which drive driven members, 62, through springs, 63. The springs, 63, compress under the torque force and thus the gap between a driving member, 61, and the adjacent driven member, 62, opposite the spring, 63, is proportional to torque. The speed sensor of FIG. 4 comprises a ring gear, 64, with a very large number of magnetic material teeth, each of which actuates the counter pickup, 65, and hence these speed counts per unit of time are proportional to the speed of the common final output shaft, 8. The ring gear counts can also be counted for the time interval between passage of the driving member, 61, and passage of the adjacent driven member, 62, opposite the spring, 63, via the counter pickups, 66, 67, actuated by the magnetic material inserts, 68, 69, and these torque counts are proportional to torque in the common final output shaft, 8. These sensed torque counts are compared electronically in the controller, 70, to set value of torque counts and if sensed torque counts are less than set value torque counts the controller, 70, energizes the increase solenoid valve, 71, which acts upon the leveller engine torque regulator to increase leveller engine torque as described hereinafter. When sensed torque counts are greater than set value torque counts the controller, 70, energizes the decrease solenoid valve, 72, which acts upon the leveller engine torque regulator to decrease leveller engine torque. In this way the torque in the common final output shaft, 8, is maintained steady at set value. The controller comprises a clock device so that ring gear counts per unit of time can be sensed as proportional to the speed of the shaft, 8. These speed counts are then compared electronically in the controller, 70, to set value of speed counts and if sensed speed counts are less than set value of speed counts, the controller, 70, increases the set value of torque counts, and the torque counts comparator then acts, as described above, to increase the torque output of the leveller engine until the speed of the shaft, 8, is restored to set value. The reverse controller effects occur when sensed speed counts are greater than set value of speed counts. In this way, the speed of the common final output shaft, 8, is maintained constant. The set value of speed counts can be adjusted in the controller by adjusting the knob, 73, either by hand or automatically.

A throttling type of torque regulator for the leveller engine is shown in FIG. 6 as another example of torque regulator useable with the torque sensor and speed sensor and controller of FIGS. 4 and 5. Working fluid for the leveller engine is supplied at constant pressure via the supply pipe, 74, to the throttle valve, 75, which acts to hold a set pressure to the leveller engine inlet via the inlet pipe, 76, equal to or lower than the constant pressure in the supply pipe, 74. Leveller engine torque can be thusly controlled by controlling the engine inlet pressure in the inlet pipe, 76, by action of the throttle valve, 75. The throttle valve maintains the inlet pipe pressure equal to, or proportional to, a set pressure in the comparator chamber, 77, and this set pressure is set by the action of the increase solenoid valve, 71, the decrease solenoid valve, 72, the inlet bleed orifice, 78, the outlet bleed orifice, 79, which are supplied with control gas at constant pressure via the pipe, 80, which gas is discharged to atmosphere via the pipe, 81. When leveller engine torque is to be increased, the controller, 70, opens the increase valve, 71, and the set pressure in the chamber, 77, increases, thus causing engine inlet pressure and torque output to increase. When leveller engine torque is to be decreased, the controller, 70, opens the decrease valve, 72, and the set pressure in the chamber, 77, decreases, thus causing engine inlet pressure and torque output to decrease.

The throttle torque regulator of FIG. 6 can alternatively be used with the mechanical torque and speed sensor and controller of FIG. 2 and the nozzle area torque regulator of FIG. 3 can alternatively be used with the electrical counting torque and speed sensor and controller of FIGS. 4 and 5, these Figures being thusly drawn as particular illustrative examples. Various combinations of torque sensors, speed sensors, controllers and torque regulators can be used for the purposes of this invention.

Engine plant applications may exist wherein not only does the primary engine produce periodic torque variations but so also does the driven load. Where these load variations are applied gradually, the devices of this invention will function properly. Where, however, the load torque may vary rapidly and greatly, the devices of this invention will at first respond wrongly. Note that an abrupt increase of load torque will start to slow down the common final output shaft and then the net flywheel effect of the primary engine, the leveller engine and the coupling will act to increase torque in the common final output shaft. In consequence, the torque sensor and controller will act upon the leveller engine torque regulator to reduce leveller engine torque whereas the desired response is an increase of leveller engine torque. Eventually, leveller torque will be increased when, the speed having decreased sufficiently, the speed sensor and controller has increased the set torque value, but this is an undesirable delay of response. These undesirable delayed response characteristics of the devices of this invention can be minimized to any extent desired by adding a flywheel between the driven load and the torque and speed sensors, the larger the energy absorbing capacity of this flywheel, the smaller the delay in correct response of the devices of this invention.

Having thus described my invention, what I claim is:

1. An engine governor machine for governing two or more engines, all of which are coupled to a single common power output shaft, said governor comprising:

torque regulator means for regulating the torque output of at least one of said engines;

means for sensing the torque in said common final power output shaft;

means for sensing the speed of said common final power output shaft;

control means responsive to said torque sensor means and to said speed sensor means and operative upon said torque regulator means so that the torque in said common final output shaft is essentially steady as between successive cycles and is adequate to maintain the speed of said common final output shaft essentially constant.

2. An engine governor as described in claim 1, wherein said control means comprises:

torque comparator means for comparing sensed torque of said torque sensor to set torque value and operative upon actuator means for actuating said torque regulator so that, when sensed torque is less than set torque value said torque regulator is actuated to increase torque output, and when sensed torque is more than set torque value said torque regulator is actuated to decrease torque output;

speed comparator means for comparing sensed speed of said speed sensor to set speed value and operative upon actuator means for adjusting said set torque value so that, when sensed speed is less than set speed value, said set torque value is increased, and when sensed speed is more than set speed value said set torque value is decreased.

3. An engine governor as described in claim 1 or 2, and further comprising:

means for adjusting said set speed value.

4. An engine governor as described in claim 1 or 2 wherein:

said torque sensor is a transmission type torque sensor.

5. An engine governor as described in claim 1 or 2, wherein:

said torque sensor is a transmission type torque sensor;

said torque sensor further comprises a torque arm and a dashpot connected between said torque arm and a fixed base.

6. An engine governor as described in claim 1 or 2 wherein:

said torque sensor is a deflection type torque sensor.

7. An engine governor as described in claim 1 or 2, wherein:

said torque sensor is a deflection type torque sensor; and further comprising:

a dashpot connected between the deflecting portions of said deflection type torque sensor.

8. An engine governor as described in claim 1 or 2, wherein:

said speed sensor is a time interval counter.

9. An engine governor as described in claim 1 or 2, wherein:

said speed sensor is a direct speed sensor.

10. An engine plant comprising:

a primary engine whose torque and power may have a periodic variation and comprising a power output shaft;

a leveller engine, whose power generating capacity is at least equal to the maximum periodic variation of power of said primary engine, and comprising a power output shaft and a torque regulator means;

means for coupling said primary engine power output shaft and said leveller engine power output shaft to a single common final power output shaft;

means for sensing the torque in said common final power output shaft;

means for sensing the speed of said common final power output shaft;

control means responsive to said torque sensor means and to said speed sensor means and operative upon said torque regulator means of said leveller engine so that the torque in said common final output shaft is essentially steady as between successive cycles and is adequate to maintain the speed of said common final output shaft essentially constant.

11. An engine plant as described in claim 10 wherein said control means comprises:

torque comparator means for comparing sensed torque of said torque sensor to set torque value and operative upon actuator means for actuating said torque regulator of said leveller engine so that, when sensed torque is less than set torque value, said torque regulator is actuated to increase leveller engine torque output, and when sensed torque is more than set torque value said torque regulator is actuated to decrease leveller engine torque output;

speed comparator means for comparing sensed speed of said speed sensor to set speed value and operative upon actuator means for adjusting said set torque value so that, when sensed speed is less than set speed value, said set torque value is increased, and when sensed speed is more than set speed value said set torque value is decreased.

12. An engine plant as described in claim 10, or 11, and further comprising:

means for adjusting said set speed value.

13. An engine plant as described in claim 10, or 11, wherein:

said torque sensor is a transmission type torque sensor.

14. An engine plant as described in claim 10, or 11, wherein:

said torque sensor is a transmisson type torque sensor;

said torque sensor further comprises a torque arm and a dashpot connected between said torque arm and a fixed base.

15. An engine plant as described in claim 10, or 11, wherein:

said torque sensor is a deflection type torque sensor.

16. An engine plant as described in claim 10, or 11, wherein:

said torque sensor is a deflection type torque sensor; and further comprising:

a dashpot connected between the deflecting portions of said deflection type torque sensor.

17. An engine plant as described in claim 10, or 11, wherein:

said speed sensor is a time interval counter.

18. An engine plant as described in claim 10, or 11, wherein:

said speed sensor is a direct speed sensor.

19. An engine plant as described in claim 10, or 11, and further comprising:

a load flywheel on said common final power output shaft positioned between said torque sensor and the load being driven by said engine plant.

* * * * *